US005408246A

United States Patent [19]

Inaba et al.

[11] Patent Number: 5,408,246

[45] Date of Patent: Apr. 18, 1995

[54] ELECTRO-OPTICAL MODULATING APPARATUS AND DRIVING METHOD THEREOF

[75] Inventors: Yutaka Inaba, Kawaguchi; Makoto Kojima, Hino, both of Japan

[73] Assignee: Canon Kabushiki Kaisha, Tokyo, Japan

[21] Appl. No.: 276,598

[22] Filed: Jul. 18, 1994

Related U.S. Application Data

[63] Continuation of Ser. No. 913,751, Jul. 17, 1992, abandoned, which is a continuation of Ser. No. 482,835, Feb. 21, 1990, abandoned.

[30] Foreign Application Priority Data

Mar. 2, 1989 [JP] Japan ..... 1-048554

[51] Int. Cl.[6] ..... G09G 3/36

[52] U.S. Cl. ..... 345/89; 345/97

[58] Field of Search ..... 345/89, 147, 63, 97; 359/54, 55, 56

[56] References Cited

U.S. PATENT DOCUMENTS

| | | | |
|---|---|---|---|
| 4,367,924 | 1/1983 | Clark et al. | 350/334 |
| 4,712,877 | 12/1987 | Okada et al. | 350/350 S |
| 4,725,129 | 2/1988 | Kondo et al. | 350/350 S |
| 4,747,671 | 5/1988 | Takahashi et al. | 350/336 |
| 4,765,720 | 8/1988 | Toyono et al. | 350/350 S |
| 4,818,078 | 4/1989 | Mouri et al. | 350/350 S |
| 4,836,656 | 6/1989 | Mouri et al. | 350/350 |

OTHER PUBLICATIONS

M. Schadt and W. Helfrich, "Voltage-Dependent Optical Activity of a Twisted Nematic Liquid Crystal", *Applied Physics Letters*, vol. 18, No. 4; Feb. 15, 1971, pp. 27–28.

*Primary Examiner*—Ulysses Weldon
*Assistant Examiner*—Regina Liang
*Attorney, Agent, or Firm*—Fitzpatrick, Cella, Harper & Scinto

[57] ABSTRACT

An electro-optical modulating system comprised of a liquid crystal device with a plurality of pixels each comprising a pair of opposite electrodes, and an optical modulating substance assuming a first molecular orientation state and a second molecular orientation state between the electrodes. The system further comprises voltage application circuit for applying to a pixel among said plurality of pixels a first voltage for resetting the pixel to be occupied with the first molecular orientation state, a second voltage for resetting the pixel into a mixture state, including a minor proportion of the first molecular orientation state and a major proportion of the second molecular orientation state, and then a third voltage for causing a prescribed ratio of the first to second molecular orientation state at the pixel not smaller than the ratio in the mixture state.

32 Claims, 7 Drawing Sheets

V = 0 V < Vth Vth < V < Vsat Vsat < V

LOW-THRESHOLD PIXEL
HIGH-THRESHOLD PIXEL
$-V_1$
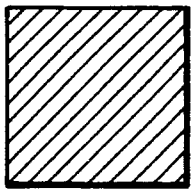
0
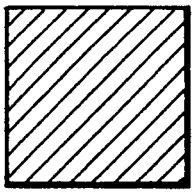
0
FIG. 6A-1 FIG. 6B-1
$V_2$
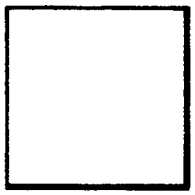
1
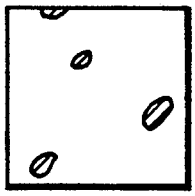
1 − x
FIG. 6A-2 FIG. 6B-2
$-V_3$
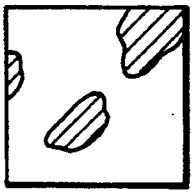
1 − y
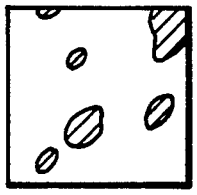
1 − y
FIG. 6A-3 FIG. 6B-3

ELECTRO-OPTICAL MODULATING APPARATUS AND DRIVING METHOD THEREOF

This application is a continuation of application Ser. No. 07/913,751, filed on Jul. 17, 1992, now abandoned, which is a continuation application of Ser. No. 07/482,835, filed on Feb. 21, 1990.

FIELD OF THE INVENTION AND RELATED ART

The present invention relates to an optical modulating apparatus using a ferroelectric liquid crystal and a driving method therefor, particularly an optical modulation apparatus suitable for halftone display or full-color display and a driving method therefor.

Hitherto, liquid crystal display devices are well known, which comprise a group of scanning electrodes and a group of data electrodes arranged to form a matrix, and a liquid crystal is filled between the electrode groups to form a large number of pixels, thereby to display images or information. These display devices are driven by a multiplexing drive scheme wherein an address signal is applied sequentially and cyclically to the scanning electrodes, and prescribed data signals are selectively applied in parallel to the data electrodes in synchronism with the address signal.

Most liquid crystals which have been put into practice for the above purpose are TN (twisted nematic)-type liquid crystals, as shown in "Voltage-Dependent Optical Activity of a Twisted Nematic Liquid Crystal" by M. Schadt and W. Helfrich, Applied Physics Letters, vol. 18, No. 4 (1971), pp. 127–128.

In recent years, as an improvement to the conventional liquid crystal devices, Clark and Lagerwall have proposed the use of a liquid crystal device showing bistability, e.g., in U.S. Pat. No. 4,367,924. As the bistable liquid crystal, a ferroelectric liquid crystal in chiral smectic C phase (SmC*) or H phase (SmH*) is generally used. In these phases, such a ferroelectric liquid crystal shows bistability, i.e., a property of assuming either a first molecular orientation state or a second molecular orientation state depending on an electric field applied thereto and retaining the resultant state in the absence of an electric field. Further, the ferroelectric liquid crystal quickly responds to a change in electric field and is therefore expected to be widely used in the field of high-speed and memory-type display apparatus.

A ferroelectric liquid crystal device has been generally used as a binary (white and black) display device wherein the above-mentioned two stable molecular orientation states and used for providing light-transmitting and light-interrupting states but is able to also provide multiple display states, i.e., a halftone or gray-scale display. According to a type of halftone display method, an areal ratio of bistable states in a pixel is controlled to provide an intermediate light-transmission. This method (areal modulation method) is explained in more detail hereinbelow.

FIG. 2 is a view schematically illustrating a relationship between the switching pulse amplitude and the resultant transmittance, more specifically a graph showing a variation of a transmittance (or transmitted light quantity) I of a cell (device) which has been originally in a completely light-interrupting state as a function of the amplitude V of a single pulse applied thereto. If the pulse amplitude V is below a threshold $V_{th}$ ($V<V_{th}$), the transmittance does not change and the resultant transmission state is as shown in FIG. 3B which is not different from the state before the pulse-application shown in FIG. 3A. If the pulse amplitude exceeds the threshold ($V_{th}<V_{sat}$), the pixel is partially transformed into the other optical state, to provide an intermediate transmission state as shown in FIG. 3C, giving an intermediate transmittance as a whole. If the pulse amplitude is further increased to exceed a saturation value $V_{sat}$ ($V_{sat}<V$), the whole pixel is transformed into a light-transmitting state as shown in FIG. 3D to reach a constant transmittance.

Thus, in the areal modulation method, the applied voltage is controlled to provide an amplitude V satisfying $V_{th}<V<V_{sat}$ to display a halftone.

However, the areal modulation method has been found to involve a serious defect as will be described below. This arises from a fact that the relationship between the voltage and the transmittance shown in FIG. 2 depends on the cell thickness and temperature and if there is a distribution in cell thickness or temperature over a display panel area, different levels of gradation are displayed at the same amplitude of applied voltage pulse. FIG. 4 is a view for describing this fact. FIG. 4 is a graph showing a relationship between voltage amplitude V and transmittance I, similarly as FIG. 2, but shows two curves at different temperatures including a curve H representing a relationship at a higher temperature and a curve L representing a relationship at a lower temperature. In a display panel of a large display size, it is common that a temperature distribution occurs in the same panel, and as a result, even if a prescribed halftone is intended to be displayed at a certain voltage $V_{ap}$, the resultant gradation levels can fluctuate ranging from $I_1$ to $I_2$ as shown in FIG. 4, thus failing to provide a uniform display of the prescribed halftone. The switching voltage of a ferroelectric liquid crystal is generally high at a low temperature and low at a high temperature, and the difference depends on the temperature-dependent viscosity change of the liquid crystal and is therefore much larger than in the conventional TN-type liquid crystal devices. Accordingly, the change in gradation level due to temperature distribution is much more noticeable than in the TN-liquid crystal and has provided the most serious obstacle to realization of a halftone or gradational display by a ferroelectric liquid crystal device.

SUMMARY OF THE INVENTION

An object of the present invention is to provide an electro-optical modulating apparatus, particularly a ferroelectric liquid crystal apparatus, having solved the above-mentioned problems to provide a uniform halftone level, and a driving method therefor.

According to an aspect of the present invention, there is provided an electro-optical modulation system (apparatus and method) including a liquid crystal display apparatus having a display unit for display of images or data. Such display comprises scanning electrodes and data electrodes arranged to form an electrode matrix, and a ferroelectric liquid crystal showing bistability with respect to an electric field applied thereto disposed between the scanning electrodes and data electrodes. Therein, all the pixels on a selected scanning electrode are completely reset into a first molecular orientation state of the liquid crystal in a first step and incompletely reset into a second molecular orientation state of the liquid crystal in a second step, and the respective pixels on the selected scanning electrode are restored toward the first molecular orientation state in a third step, so as to display a halftone.

According to another aspect of the present invention, there is provided an electro-optical modulating apparatus, comprising:

a liquid crystal device processing a plurality of pixels each comprising a pair of opposite electrodes, and an optical modulating substance assuming a first molecular orientation state and a second molecular orientation state between the electrodes, and voltage application means for applying to a pixel among said plurality of pixels a first voltage for resetting the pixel to be occupied with the first molecular orientation state, a second voltage for resetting the pixel into a mixture state including a minor proportion of the first molecular orientation state and a major proportion of the second molecular orientation state, and then a third voltage for causing a prescribed ratio of the first to second molecular orientation state at the pixel not smaller than the ratio in said mixture state.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 6A-1 to 6A-3 and FIGS. 6B-1 to 6B-3 are schematic views illustrating transmission states of a low-threshold pixel and a high-threshold pixel, respectively, after application of reset pulses and a gradation pulse according to the present invention.

DESCRIPTION OF THE PREFERRED EMBODIMENTS

According to a first embodiment of the present invention, a uniform halftone is displayed by:

applying a first voltage for resetting all the pixels on a selected scanning electrode to be occupied with the first molecular orientation state, applying a second voltage for resetting all or a prescribed number of the pixels on the selected scanning electrode into a mixture state including a minor proportion of the first molecular orientation state and a major proportion of the second molecular orientation state, and applying a third voltage for causing a prescribed ratio of the first to second molecular orientation state not smaller than the ratio in said mixture state at a pixel on the selected scanning electrode.

According to a second embodiment of the present invention, a halftone is displayed by:

a first step of applying voltage signals to the scanning electrodes and data electrodes of an electrode matrix so as to apply a first voltage for resetting all the pixels on all or a prescribed number of the scanning electrodes to be occupied with the first molecular orientation state, a second step of applying voltage signals to the scanning electrodes and data electrodes so as to apply a second voltage for resetting all or a prescribed number of the pixels on said all or a prescribed number of the scanning electrodes into a mixture state including a minor proportion of the first molecular orientation state and a major proportion of the second molecular orientation state, and a third step of applying a scanning selection signal to a scanning electrode and applying data signals to the data electrodes in synchronism with the scanning selection so as to apply a third voltage for causing a prescribed ratio of the first to second molecular orientation state at the respective pixels on the scanning electrode not smaller than the ratio in said mixture state.

Figure 5A:
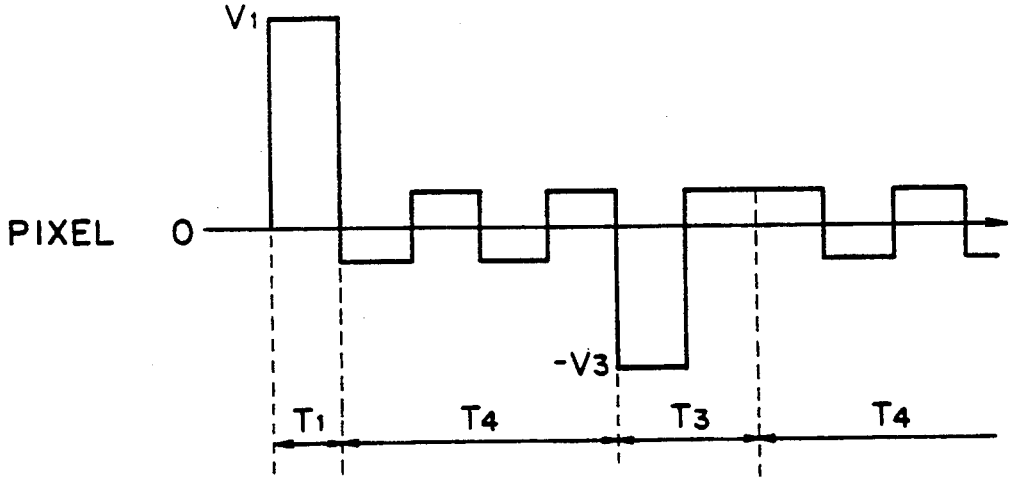
FIG. 5A PRIOR ART
FIGS. 5A and 5B are time charts showing time serial waveforms of applied pulses used for gradational display in multiplexing drive according to prior art and the present invention, respectively.

A ferroelectric liquid crystal device has a memory characteristic, so that it is generally necessary to apply a pulse for clearing a display state in order to rewrite the display state. For this reason, in the conventional driving method, a halftone display pulse is applied to a pixel after the pixel is completely reset into one molecular orientation state. This sequence of operation is directly affected by the above-mentioned influences of the cell thickness distribution and the temperature distribution, thus failing to provide a uniform halftone level. More specifically, FIG. 5A shows an example of applied pulse waveform for conventional gradational display by multiplexing drive. As shown in the figure, it is conventional that prescribed pixels are reset into a first molecular orientation state by application of a simultaneous clearing pulse having an amplitude $V_1$ in a period $T_1$. Then a scanning line is sequentially selected so that a pixel is supplied with a pulse having an amplitude $V_3$ corresponding to given gradation data to be partially transformed into a second molecular orientation state in a selection period $T_3$ after an arbitrary non-selection period $T_4$.

Figure 5B:
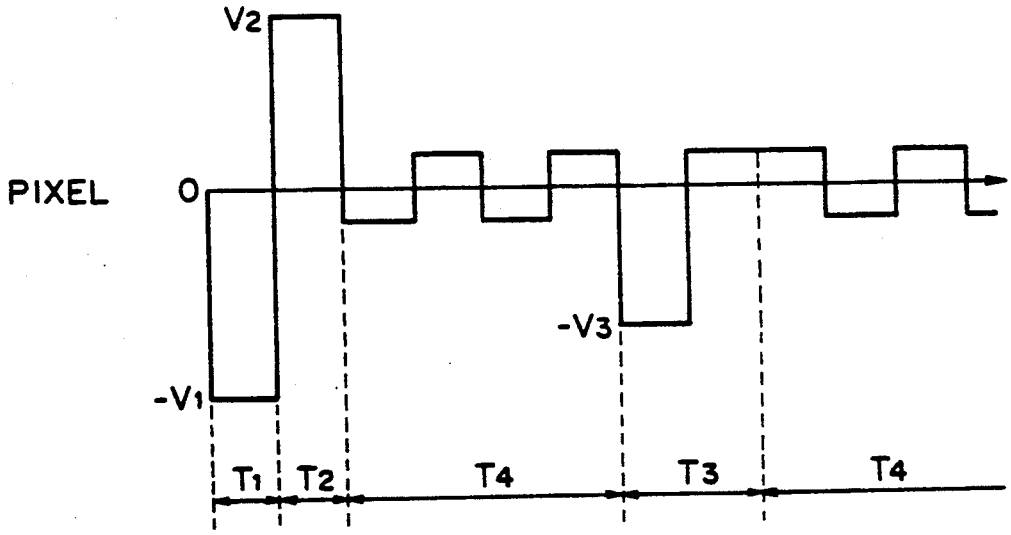

In contrast thereto, in the present invention, as shown in FIG. 5B, a pixel is first completely cleared into one molecular orientation state by applying a pulse with a voltage amplitude of $-V_1$, then reset into the other molecular orientation state by applying a pulse having an amplitude $V_2$ of the other polarity and thereafter supplied with a halftone display pulse having an amplitude $-V_3$. In this instance, the amplitude $V_1$ of the first clearing or reset pulse is set to be not lower than the maximum value in the panel of the saturation voltage value $V_{sat(max)}$, and the amplitude $V_2$ of the second clearing or reset pulse is set to be not higher than the minimum value in the panel of the saturation voltage value $V_{sat(min)}$. Thus, $V_1 \geqq V_{sat(max)}$ and $V_2 \leqq V_{sat(min)}$. As a result, after the application of the first clearing pulse $V_1$, all the pixels are completely placed in the first molecular orientation state, and after the application of the second clearing pulse, the pixels are incompletely placed in the second molecular orientation state with the first molecular orientation state partially left in some pixels.

From actual points of view, it is preferred to set $V_1 = V_{sat(max)}$ so as not to excessively increase the drive voltage, and it is preferred to set $v_2 = V_{sat(min)}$ so as to provide as large a gradation display range as possible. When $V_2$ is set to satisfy $V_2 = V_{sat(min)}$, pixels placed in an incompletely reset state by application of the second clearing pulse $V_2$ are those having a saturation voltage close to $V_{sat(max)}$, i.e., pixels in a high threshold region (at a low temperature or having a large cell gap), and pixels having a saturation voltage close to $V_{sat(min)}$, i.e., pixels in a low threshold region (at a high temperature or having a small cell gap) are almost completely reset into the second molecular orientation state. Hereinbelow, a case of $V_2 = V_{sat(min)}$ is taken as an example for explanation.

FIGS. 6A-1 to 6A-3 and FIGS. 6B-1 to 6B-3 illustrate the states of a pixel in a low-threshold region (FIGS. 6A-1 to 6A-3) and a pixel in a high-threshold region (FIGS. 6B-1 to 6B-3) after application of a first reset pulse ($-V_1$), a second reset pulse ($V_2$) and a gradation display data pulse ($-V_3$) in this order. The numerals "0", "1", "1-x" and "1-y" indicated near the pixels represent a ratio of the area in a pixel occupied by the second molecular orientation state. After the application of the second reset pulse, a low-threshold pixel assumes the second molecular orientation state at a rate of nearly 100%, while a high-threshold pixel partially remains in the first molecular orientation state. The incompletely reset or cleared rate of a pixel is represented by x:(1-x), i.e., an areal ratio between the first molecular orientation state and the second molecular orientation state in the pixel.

Then, each pixel is supplied with a display data pulse having a pulse amplitude $V_3$ corresponding to given gradation data. The display data pulse has a polarity in a direction of causing the first molecular orientation state and its amplitude $V_3$ to be set within the range of $V_{th(max)} \leqq V_3 \leqq V_2$. As a result, the pixel is partially restored to the first molecular orientation state. The degree of the restoration is represented by y:(1-y), i.e., an areal ratio between the first molecular orientation state and the second molecular orientation state after the application, which corresponds to an inversion ratio at a low-threshold pixel which has been placed in the second molecular orientation state at a rate of 100%.

Figure 1:
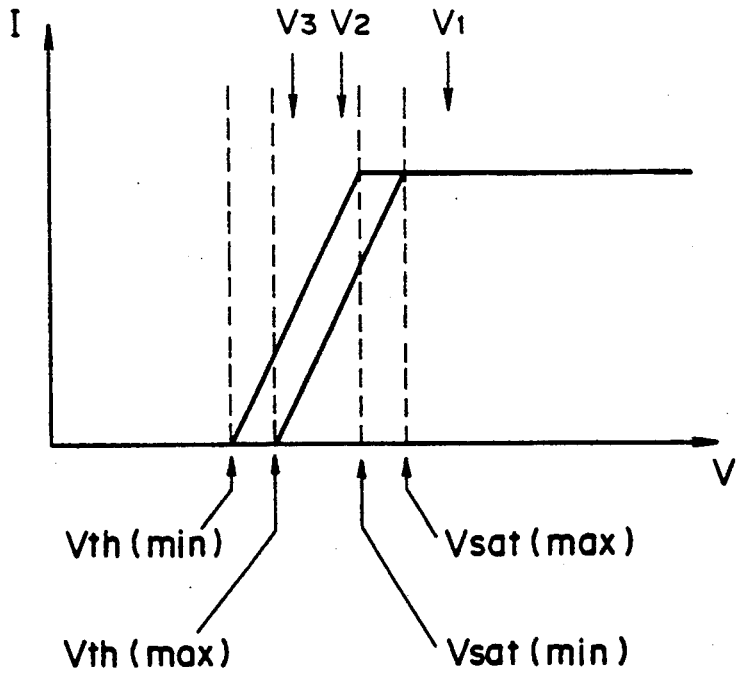
FIG. 1 is a graph illustrating examples of the amplitudes of the first and second reset pulses and the gradation pulse used in the present invention together with the resultant transmittances.
Figure 2:
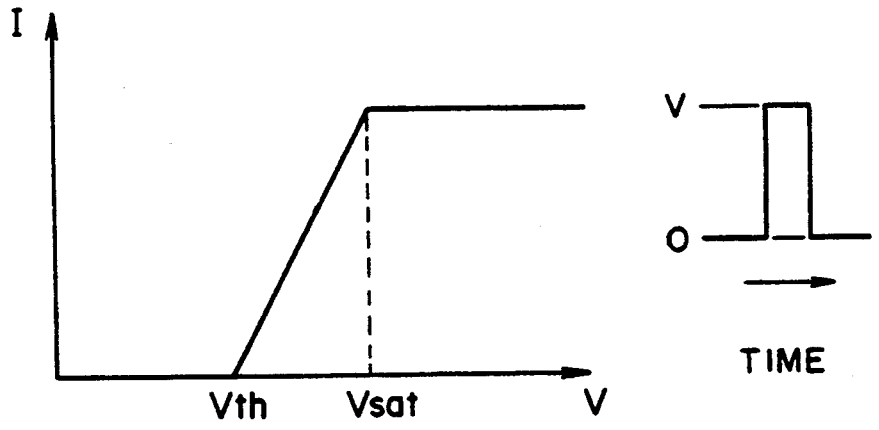
FIG. 2 PRIOR ART
FIG. 2 is a schematic view illustrating a relationship between the switching pulse amplitude and the transmittance of a ferroelectric liquid crystal device.
Figures 3A, 3B, 3C, 3D:
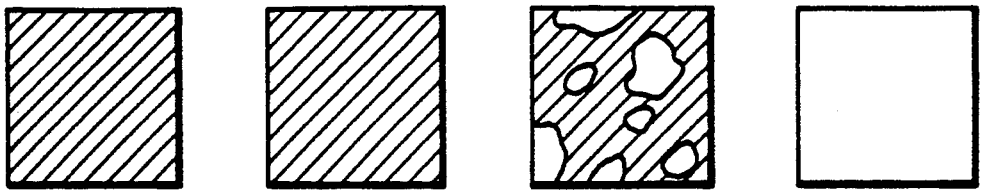
FIG. 3A PRIOR ART FIG. 3B PRIOR ART FIG. 3C PRIOR ART FIG. 3D PRIOR ART
FIGS. 3A–3D are illustrations of various transmission states of a ferroelectric liquid crystal cell depending on applied pulses.
Figure 4:
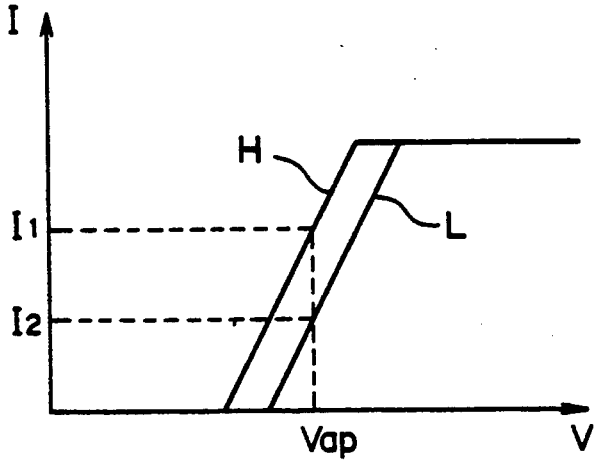
FIG. 4 is a graph showing a difference in relationship between voltage amplitude V-transmittance I at higher and lower temperatures.

A high-threshold pixel shows a lower inversion ratio than Z in response to a data pulse having the same amplitude $V_3$. More specifically, a high-threshold pixel shows an inversion ratio lower by x than a low-threshold pixel in response to the reset pulse having an amplitude $V_2$ and shows a lower inversion ratio than the low-threshold pixel by nearly the same degree also in response to the gradation pulse having an amplitude $V_3$. Thus, the high-threshold pixel shows an inversion ratio of y-x, and the resultant areal ratio between the first molecular orientation state and the second molecular orientation state after the gradation pulse application is (y-x):[1−(y-x)] if the pixel is assumed to be placed in the second molecular orientation state at a rate of 100%. However, a high-threshold pixel after the second reset pulse application is not actually placed in the second molecular orientation state at a rate of 100% but is placed in a mixture state having an areal ratio of x:(1-x) of the first and second molecular orientation states. In the mixture state, the portion x in the first molecular orientation state is a portion which has not been inverted by the application of the second reset pulse $V_2$ and is relatively difficult to invert, i.e., having a higher threshold, in the pixel. Accordingly, the portion x is not affected by application of the gradation pulse $V_3$ but retains the first molecular orientation state. On the other hand, the portion (1-x) in the second molecular orientation state is a portion which is relatively easy to invert, so that it is transformed into the first molecular orientation state according to the above-mentioned inversion rate. As a result, the high-threshold pixel after the gradation pulse application assumes the following mixture state:

Area of 1st. molecular orientation state $= x + (y-x) = y$;

Area of 2nd. molecular orientation state $= (1-x) - (y-x) = 1-y$;

The areal ratio in a high-threshold pixel is identical to that in a low-threshold pixel. This is shown in FIGS. 6A-3 and 6B-3.

The above results are summarized in Table 1 appearing hereinafter.

In contrast thereto, according to the conventional driving method, a second reset pulse is not used, but both a low-threshold pixel and a high-threshold pixel are reset into the first molecular orientation state at a rate of 100% over the entire area by application of a first reset pulse ($V_1$ of a polarity opposite to that shown in Table 1), immediately followed by application of a gradation pulse. As a result, the areal ratio between the first molecular orientation state and the second molecular orientation state is y:(1-y) for a low-threshold pixel which is the same as in the present invention but is (y-x):[1−(y-x)]. The results in the conventional case are summarized in Table 2 below.

TABLE 1

| | | After application of | | |
|---|---|---|---|---|
| | | 1st reset pulse ($-V_1$) | 2nd reset pulse ($V_2$) | gradation pulse ($-V_3$) |
| Low-threshold pixel | 1st molecular orientation state | 1 | 0 | y |
| | 2nd molecular orientation state | 0 | 1 | 1-y |
| High-threshold pixel | 1st molecular orientation state | 1 | x | y |
| | 2nd molecular orientation state | 0 | 1-x | 1-y |

TABLE 2

| | | After application of | |
|---|---|---|---|
| | | reset pulse ($V_1$) | gradation pulse ($-V_3$) |
| Low- | 1st molecular | 0 | y |

TABLE 2-continued

| | | After application of | |
|---|---|---|---|
| | | reset pulse ($V_1$) | gradation pulse ($-V_3$) |
| threshold pixel | orientation 2nd molecular orientation state | 1 | 1-y |
| High-threshold pixel | 1st molecular orientation state | 0 | y-x |
| | 2nd molecular orientation state | 1 | 1-(y-x) |

As described above, according to the present invention, reset pulses are applied in two steps, of which the second one is made an incomplete reset pulse, whereby an irregularity of gradation over a panel due to a fluctuation in temperature or cell thickness is eliminated.

Accordingly, as is apparent in view of Tables 1 and 2 in comparison, a uniform gradation level can be attained according to the present invention, while a difference in gradation level occurs between a low-threshold pixel (or region) and a high-threshold pixel (or region) according to the conventional system. Further, according to the conventional system, it has been difficult to display a fine gradation over a certain number of levels due to the above-mentioned fluctuation in gradation level, whereas a finer gradation display has become possible due to an improved uniformity according to the present invention.

EXAMPLE

Hereinbelow, the present invention will be explained by way of an example.

Figure 7:
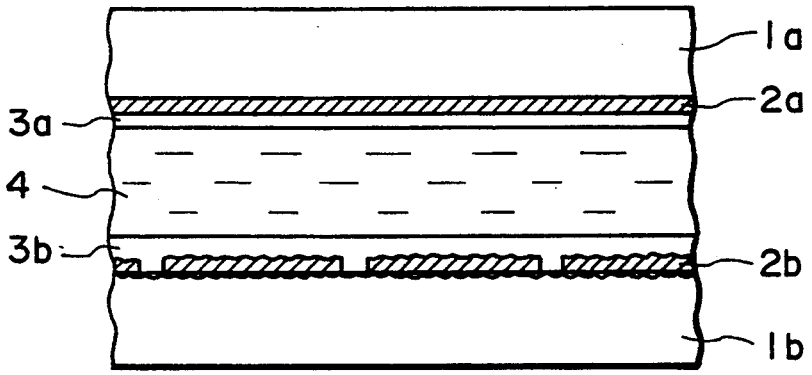
FIG. 7 is a sectional view of a liquid crystal display device according to an embodiment of the present invention wherein a minute unevenness is provided to electrode surfaces on one substrate so as to form a threshold distribution in a pixel.
Figure 8:
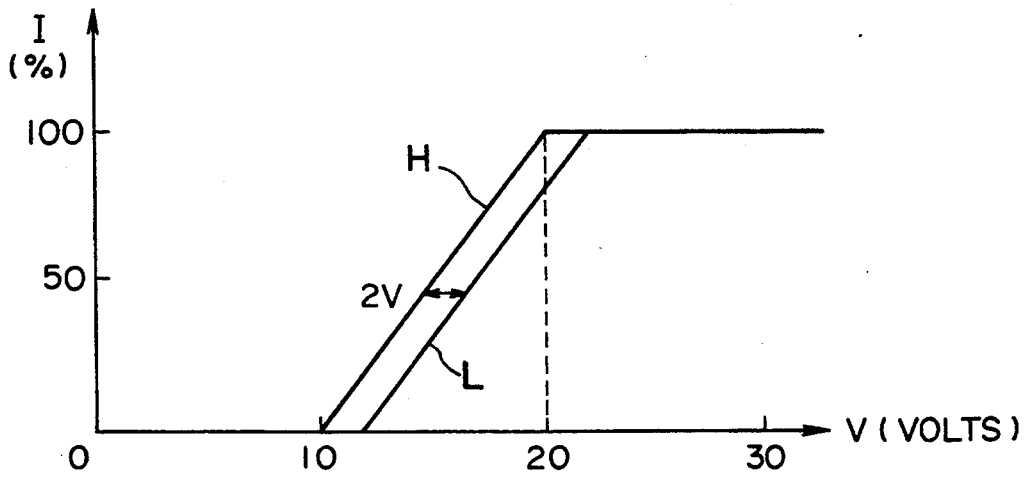
FIG. 8 is a graph showing threshold characteristics at a highest temperature point (26.5° C.) and a lowest temperature point (24.5° C.) in the display region in the apparatus shown in FIG. 1.

FIG. 7 shows a partial schematic sectional view of a liquid crystal cell (device) which comprises a pair of glass substrates 1*a* and 1*b*, of which the substrate 1*b* had a roughened surface as a result of etching with a hydrofluoric acid. The substrates were provided with 1500 Å-thick and 200 μm-wide transparent electrodes 2*a* and 2*b* forming scanning electrodes and data electrodes. The transparent electrodes 2*b* retained a minute unevenness so as to provide a threshold distribution in a pixel because of the roughened substrate lb. The electrodes 2*a* and 2*b* were covered with a pair of alignment films 3*a* and 3*b* of 300 Å-thick rubbled polyimide film, between which a ferroelectric liquid crystal "CS-1014" (trade name, available from Chisso K.K.) was hermetically sealed in a thickness of 1.4 μm. A liquid crystal device thus prepared having a JIS A4 size showed a temperature distribution over a display area including a maximum temperature of 26.5° C. and a minimum temperature of 24.5° C., and these maximum temperature point and minimum temperature point showed threshold characteristics as represented by curves H and L, respectively, shown in FIG. 8.

From the figure, the amplitudes of a first reset pulse $V_1$, a second reset pulse $V_2$ and a gradiation pulse $V_3$ were set as follows:

$$V_1=22\text{ V},\ V_2=20\text{ V, and } 12\text{ V}\leqq V_3\leqq 20\text{ V}.$$

Figure 9:
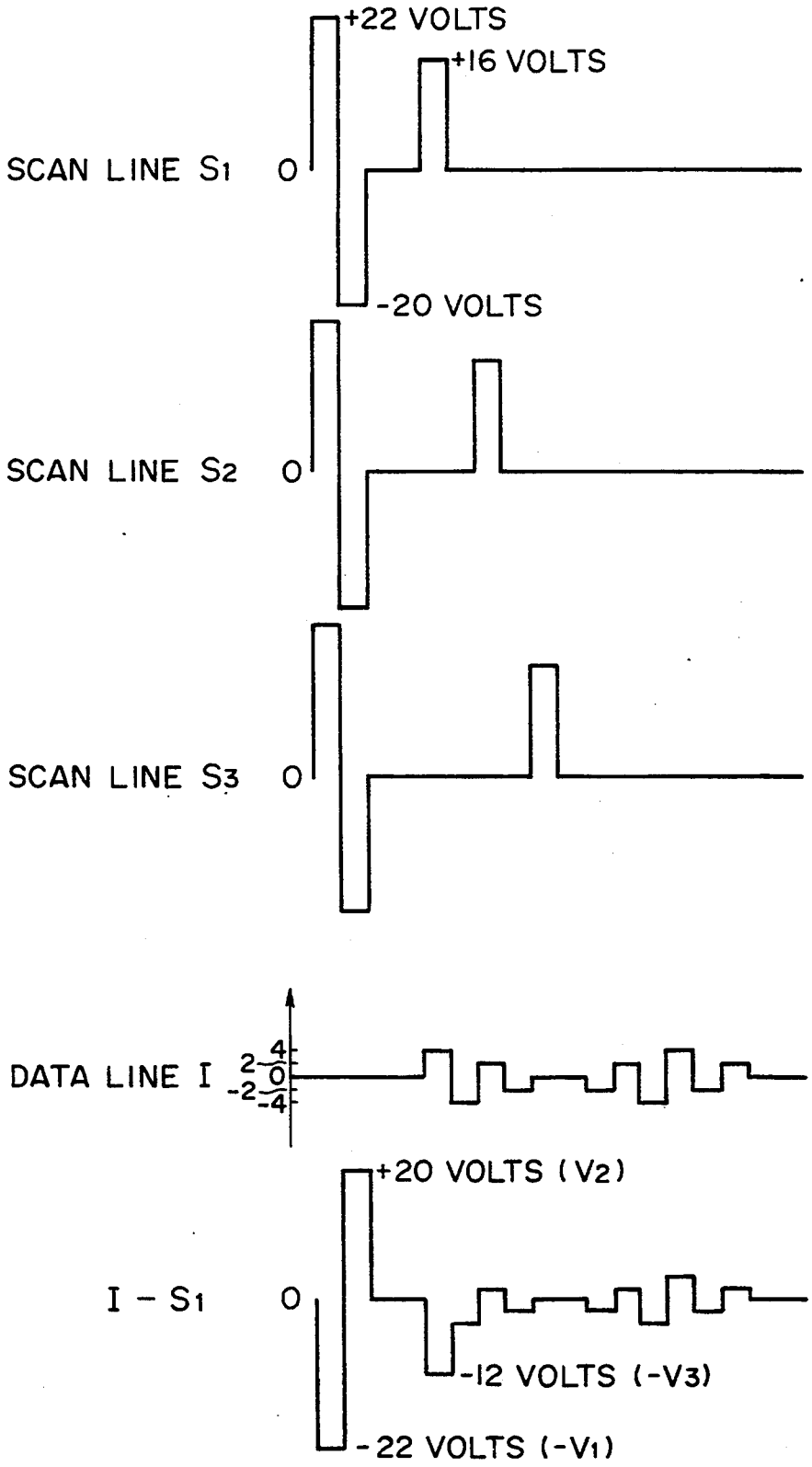
FIG. 9 is a time chart showing a set of driving waveforms applied to scanning lines and a data line of a device as shown in FIG. 3. According to the present invention.

Further, a scanning selection signal having an amplitude $V_s$ of 16 V was sequentially applied to scanning lines $S_1$, $S_2$, $S_3$ . . . and data signals having an amplitude $V_I$ changing within the range of $-4\text{ V}\leqq V_I\leqq 4\text{ V}$ depending on given gradation data as shown in FIG. 9 corresponding to the above-mentioned second embodiment were applied. As a result, during the operation for display of halftones in the above described manner, a luminance irregularity between the high-temperature point and the low-temperature point was not substantially observed.

In the above example, a driving mode for gradational display through pulse amplitude modulation was adopted, but the present invention is also applicable to other known driving modes wherein the pulse duration or pulse number is varied depending on given gradation data.

Further, in the above example, the voltages $V_1$ and $V_2$ were set so as to satisfy the conditions of $V_1=V_{sat(max)}$ and $V_2=V_{sat(min)}$, but it is possible to adopt a setting of $V_2<V_{sat(min)}$ if a coarser degree of gradation is tolerable. Even in such a case, the effect of suppressing gradation irregularity is not impaired.

Figure 10:
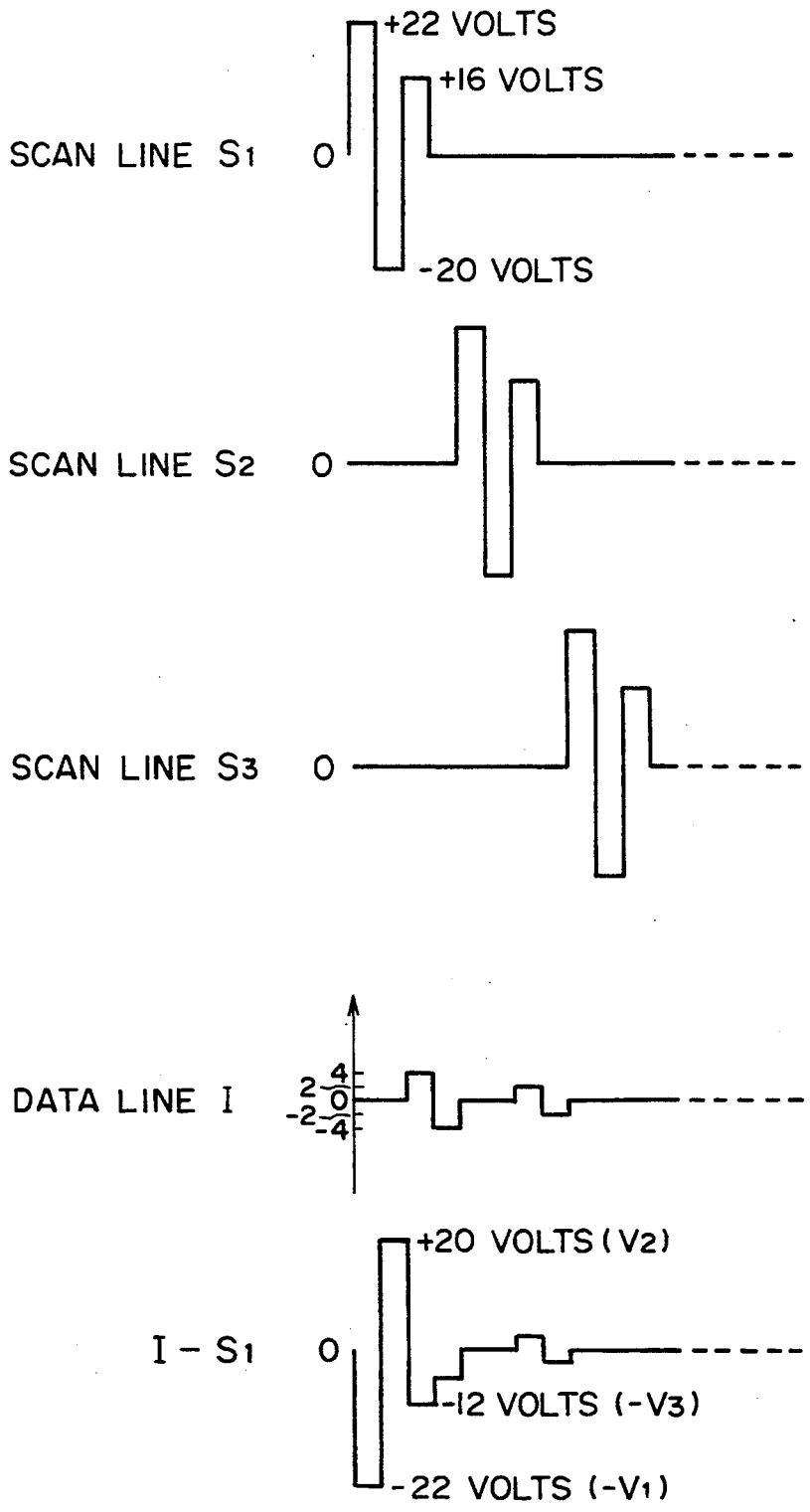
FIG. 10 is a time chart showing another set of driving waveforms according "to another embodiment of the present invention.

On the other hand, FIG. 10 shows another set of driving waveforms for gradational display corresponding to the above-mentioned first embodiment of the present invention.

As described above, according to the present invention, reset pulses are applied in two steps, of which the second reset pulse is applied as an incomplete reset pulse, whereby an irregularity of gradation over a panel due to a fluctuation in temperature or cell thickness is eliminated to afford a display at a uniform gradation level. Further, according to the conventional system, it has been difficult to display a fine gradation over a certain number of levels due to the above-mentioned fluctuation in gradation level, whereas a finer gradation display has become possible due to an improved uniformity according to the present invention.

What is claimed is:

1. An electro-optical modulating apparatus, comprising:

a liquid crystal device comprising a plurality of pixels forming a display area having a low-threshold region including a pixel having a saturation voltage of $V_{sat(min)}$, and a high threshold region, including a pixel having a saturation voltage of $V_{sat(max)}$, each of said plurality of pixels comprising a pair of opposite electrodes and an optical modulation substance, capable of assuming a first molecular orientation state and a second molecular orientation state, between the electrodes; and voltage application means for sequentially applying, to each pixel, a first voltage $V_I$ of one polarity of at least $V_{sat(max)}$, a second voltage $V_2$ of the opposite polarity of at most $V_{sat(min)}$ and a third voltage $V_3$ of the one polarity set to a value within the range of $V_{th(max)}$ to the second voltage $V_2$, wherein $V_{sat(max)}$ denotes a maximum saturation voltage value among saturation voltages occurring in the plurality of pixels, $V_{sat(min)}$ denotes a minimum saturation voltage value among the saturation voltages occurring in the plurality of pixels, and $V_{th(max)}$ denotes a maximum threshold voltage value among threshold voltages occurring in the plurality of pixels.

2. An apparatus according to claim 1, wherein said optical modulating substance comprises a ferroelectric liquid crystal.

3. An apparatus according to claim 1, wherein said optical modulating substance comprises a ferroelectric liquid crystal showing bistability.

4. An apparatus according to claim 1, wherein said third voltage comprises a voltage signal depending on given gradation data.

5. An apparatus according to claim 1, wherein said plurality of pixels are arranged in a plurality of rows and a plurality of columns so as to form a matrix.

6. An apparatus according to claim 1, wherein the first voltage $V_1$ is applied immediately before the second voltage $V_2$.

7. An apparatus according to claim 1, wherein said voltage application means includes means for applying an alternating voltage between the period of application of the second voltage $V_2$ and the period of application of the third voltage $V_3$.

8. An apparatus according to claim 1, wherein said voltage application means includes means for applying an alternating voltage after the application of the third voltage $V_3$.

9. An electro-optical modulating apparatus, comprising:

a liquid crystal device comprising an electrode matrix comprising scanning electrodes and data electrodes intersecting the scanning electrodes, and an optical modulating substance showing a first molecular orientation state and a second molecular orientation state disposed between the scanning electrodes and data electrodes so as to form a plurality of pixels each at an intersection of the scanning electrodes and data electrodes, said plurality of pixels forming a display area having a low-threshold region, including a pixel having a saturation voltage of $V_{sat(min)}$, and a high threshold region, including a pixel having a saturation voltage of $V_{sat(max)}$, and voltage application means for applying a scanning selection signal to a selected particular scanning electrode among the scanning electrodes, and for sequentially applying, to all or a prescribed number of the pixels on the selected particular scanning electrode, a first voltage $V_1$ of one polarity of at least $V_{sat(max)}$, a second voltage $V_2$ of the opposite polarity of at most $V_{sat(min)}$ and a third voltage $V_3$ of the one polarity set to a value within the range of $V_{th(max)}$ to the second voltage $V_2$, wherein $V_{sat(max)}$ denotes a maximum saturation voltage value among saturation voltages occurring in the plurality of pixels, $V_{sat(min)}$ denotes a minimum saturation voltage value among the saturation voltages occurring in the plurality of pixels, and $V_{th(max)}$ denotes a maximum threshold voltage value among threshold voltages occurring in the plurality of pixels.

10. An apparatus according to claim 9, wherein said optical modulating substance comprises a ferroelectric liquid crystal.

11. An apparatus according to claim 9, wherein said optical modulating substance comprises a ferroelectric liquid crystal showing bistability.

12. An apparatus according to claim 9, wherein said third voltage comprises a voltage signal depending on given gradation data.

13. An electro-optical modulating apparatus, comprising:

(A) a liquid crystal device comprising an electrode matrix comprising scanning electrodes and data electrodes intersecting the scanning electrodes, and an optical modulating substance showing a first molecular orientation state and a second molecular orientation state disposed between the scanning electrodes and data electrodes so as to form a plurality of pixels each at an intersection of the scanning electrodes and data electrodes, said plurality of pixels forming a display area having a low-threshold region, including a pixel having a saturation voltage of $V_{sat(min)}$, and a high threshold region, including a pixel having a saturation voltage of $V_{sat(max)}$; and (B) voltage application means for:

in a first step, applying a first voltage of one polarity of at least $V_{sat(max)}$ to all the pixels on all or a prescribed number of the scanning electrodes, and in a second step, (a) applying a scanning selection signal to a selected particular scanning electrode among the scanning electrodes, and (b) sequentially applying, to all or a prescribed number of the pixels on the selected particular scanning electrode, a second voltage $V_2$ of the opposite polarity of at most $V_{sat(min)}$ and a third voltage $V_3$ of the one polarity set to a value within the range of $V_{th(max)}$ to the second voltage $V_2$, wherein $V_{sat(max)}$ denotes a maximum saturation voltage value among saturation voltages occurring in the plurality of pixels;

$V_{sat(min)}$ denotes a minimum saturation voltage value among the saturation voltages occurring in the plurality of pixels, and $V_{th(max)}$ denotes a maximum threshold voltage value among threshold voltages occurring in the plurality of pixels.

14. An apparatus according to claim 13, wherein said optical modulating substance comprises a ferroelectric liquid crystal.

15. An apparatus according to claim 13, wherein said optical modulating substance comprises a ferroelectric liquid crystal showing bistability.

16. An apparatus according to claim 13, wherein said third voltage comprises a voltage signal depending on given gradation data.

17. A driving method for a liquid crystal device comprising a plurality of pixels each comprising a pair of opposite electrodes, and an optical modulating substance assuming a first molecular orientation state and a second molecular orientation state between the electrodes, said plurality of pixels forming a display area having a low-threshold region, including a pixel having a saturation voltage of $V_{sat(min)}$, and a high threshold region, including a pixel having a saturation voltage of $V_{sat(max)}$, said driving method comprising:

sequentially applying, to the plurality of pixels, a first voltage $V_1$ of one polarity of at least $V_{sat(max)}$, a second voltage $V_2$ of the opposite polarity of at most $V_{sat(min)}$ and a third voltage $V_3$ of said one polarity set to a value within the range of $V_{th(max)}$ to the second voltage $V_2$; wherein $V_{sat(max)}$ denotes a maximum saturation voltage value among saturation voltages occurring in the plurality of pixels, $V_{sat(min)}$ denotes a minimum saturation voltage value among the saturation voltages occurring in the plurality of pixels, and $V_{th(max)}$ denotes a-maximum threshold voltage value among threshold voltages occurring in the plurality of pixels.

18. A method according to claim 17, wherein the optical modulating substance comprises a ferroelectric liquid crystal.

19. A method according to claim 17, wherein the optical modulating substance comprises a ferroelectric liquid crystal showing bistability.

20. A method according to claim 17, wherein the third voltage comprises a voltage signal depending on given gradation data.

21. A method according to claim 17, wherein the plurality of pixels are arranged in a plurality of rows and a plurality of columns so as to form a matrix.

22. A method according to claim 17, wherein the first voltage $V_1$ is applied immediately before the second voltage $V_2$.

23. A method according to claim 17, wherein an alternating voltage is applied between the period of application of the second voltage $v_2$ and the period of application of the third voltage $V_3$.

24. A method according to claim 17, wherein an alternating voltage is applied after the application of the third voltage $V_3$.

25. A driving method for a liquid crystal device comprising an electrode matrix comprising scanning electrodes and data electrodes intersecting the scanning electrodes, and an optical modulating substance showing a first molecular orientation state and a second molecular orientation state disposed between the scanning electrodes and data electrodes so as to form a plurality of pixels each at an intersection of the scanning electrodes and data electrodes, said plurality of pixels forming a display area having a low-threshold region, including a pixel having a saturation voltage of $V_{sat(min)}$, and a high threshold region, including a pixel having a saturation voltage of $V_{sat(max)}$, said driving method comprising:

applying a scanning selection signal to a selected particular scanning electrode among the scanning electrodes, and sequentially applying, to all or a prescribed number of the pixels on the selected particular scanning electrode, a first voltage $V_1$ of one polarity of at least $V_{sat(max)}$, a second voltage $V_2$ of the opposite polarity of at most $V_{sat(min)}$ and a third voltage $V_3$ of the one polarity set to a value within the range of $V_{th(max)}$ to the second voltage $V_2$, wherein $V_{sat(max)}$ denotes a maximum saturation voltage value among saturation voltages occurring in the plurality of pixels, $V_{sat(min)}$ denotes a minimum saturation voltage value among the saturation voltages occurring in the plurality of pixels, and $V_{th(max)}$ denotes a maximum threshold voltage value among threshold voltages occurring in the plurality of pixels.

26. A method according to claim 25, wherein the optical modulating substance comprises a ferroelectric liquid crystal.

27. A method according to claim 25, wherein the optical modulating substance comprises a ferroelectric liquid crystal showing bistability.

28. A method according to claim 25, wherein the third voltage comprises a voltage signal depending on given gradation data.

29. A driving method for a liquid crystal device comprising an electrode matrix comprising scanning electrodes and data electrodes intersecting the scanning electrodes, and an optical modulating substance showing a first molecular orientation state and a second molecular orientation state disposed between the scanning electrodes and data electrodes so as to form a plurality of pixels each at an intersection of the scanning electrodes and data electrodes, said plurality of pixels forming a display area having a low-threshold region, including a pixel having a saturation voltage of $V_{sat(min)}$, and a high threshold region, including a pixel having a saturation voltage of $V_{sat(max)}$, said driving method comprising:

a first step of applying a first voltage $V_1$ of one polarity of at least $V_{sat(max)}$ to all the pixels on all or a prescribed number of scanning electrodes, a second step of (a) applying a scanning selection signal to a selected particular scanning electrode among the scanning electrodes, and (b) sequentially applying, to all or a prescribed number of the pixels on the selected particular scanning electrode, a second voltage $V_2$ of the opposite polarity of at most $V_{sat(min)}$ and a third voltage $V_3$ of the one polarity set to a value within the range of $V_{th(max)}$ to the second voltage $V_2$, wherein $V_{sat(max)}$ denotes a maximum saturation voltage value among saturation voltages occurring in the plurality of pixels, $V_{sat(min)}$ denotes a minimum saturation voltage value among the saturation voltages occurring in the plurality of pixels, and $V_{th(max)}$ denotes a maximum threshold voltage value among threshold voltages occurring in the plurality of pixels.

30. A method according to claim 29, wherein the optical modulating substance comprises a ferroelectric liquid crystal.

31. A method according to claim 29, wherein the optical modulating substance comprises a ferroelectric liquid crystal showing bistability.

32. A method according to claim 29, wherein the third voltage comprises a voltage signal depending on given gradation data.

* * * * *

UNITED STATES PATENT AND TRADEMARK OFFICE

CERTIFICATE OF CORRECTION

PATENT NO. : 5,408,246

DATED : April 18, 1995

INVENTOR(S) : YUTAKA INABA, ET AL.

It is certified that error appears in the above-identified patent and that said Letters Patent is hereby corrected as shown below:

COLUMN 1

Line 53, "and" should read --are--.

COLUMN 2

Line 5, "threshold ($V_{th}<V_{sat}$)," should read --threshold ($V_{th}<V<V_{sat}$),--.

COLUMN 3

Line 7, "processing" should read --possessing--.
Line 67, ""to" should read --to--.

COLUMN 5

Line 20, "$v_2=V_{sat(min)}$" should read --$V_2=V_{sat(min)}$--.
Line 64, "Z" should read --y--.

COLUMN 6

Line 31, "x)=1-y;" should read --x)=1-y.--.

COLUMN 8

Line 39, "gion" should read --gion,--.

COLUMN 9

Line 2, "third voltage" should read --third voltage $V_3$--.
Line 60, "third voltage" should read --third voltage $V_3$--.

UNITED STATES PATENT AND TRADEMARK OFFICE

CERTIFICATE OF CORRECTION

PATENT NO. : 5,408,246

DATED : April 18, 1995

INVENTOR(S) : YUTAKA INABA, ET AL.

It is certified that error appears in the above-identified patent and that said Letters Patent is hereby corrected as shown below:

COLUMN 10

Line 11, "first voltage" should read --first voltage $V_1$--.
Line 41, "third voltage" should read --third voltage $V_3$--.
Line 66, "a-maximum" should read --a maximum--.

COLUMN 11

Line 9, "third voltage" should read --third voltage $V_3$--.
Line 19, "voltage $v_2$" should read --voltage $V_2$--.

COLUMN 12

Line 11, "third voltage" should read --third voltage $V_3$--.
Line 55, "third voltage" should read --third voltage $V_3$--.

Signed and Sealed this

Fifteenth Day of August, 1995

Bruce Lehman

*Attest:*

BRUCE LEHMAN

*Attesting Officer*

*Commissioner of Patents and Trademarks*